US009196433B2

(12) United States Patent
Inaguchi et al.

(10) Patent No.: US 9,196,433 B2
(45) Date of Patent: Nov. 24, 2015

(54) ELECTROMAGNETIC SWITCH

(75) Inventors: Takashi Inaguchi, Chiyoda-ku (JP); Satoshi Makino, Chiyoda-ku (JP); Tomohiko Takemoto, Chiyoda-ku (JP); Naoki Ito, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 14/380,262

(22) PCT Filed: May 17, 2012

(86) PCT No.: PCT/JP2012/062631

§ 371 (c)(1),
(2), (4) Date: Aug. 21, 2014

(87) PCT Pub. No.: WO2013/171877

PCT Pub. Date: Nov. 21, 2013

(65) Prior Publication Data

US 2015/0035631 A1 Feb. 5, 2015

(51) Int. Cl.
*H01H 63/02* (2006.01)
*H01H 9/34* (2006.01)
(Continued)

(52) U.S. Cl.
CPC . *H01H 9/34* (2013.01); *H01H 1/12* (2013.01); *H01H 9/48* (2013.01); *H01H 50/54* (2013.01); *H01H 50/38* (2013.01)

(58) Field of Classification Search
CPC ..... H01H 13/04; H01H 3300/18; H01H 3300/20; H01H 50/64; H01H 50/54; H01H 73/04; H01H 3/28; H01H 1/06
USPC ..... 335/133
See application file for complete search history.

(56) References Cited

U.S. PATENT DOCUMENTS 8,289,110 B2 * 10/2012 Niimi et al. ..... 335/126
8,330,565 B2 * 12/2012 Eum ..... 335/126
(Continued)

FOREIGN PATENT DOCUMENTS

JP 57-57016 U1 9/1980
JP 57-90517 U 6/1982
(Continued)

OTHER PUBLICATIONS

Communication dated Feb. 24, 2015, issued by the Japanese Patent Office in counterpart Japanese application No. 2014-515425.
(Continued)

*Primary Examiner* — Shawki S Ismail
*Assistant Examiner* — Lisa Homza
(74) *Attorney, Agent, or Firm* — Sughrue Mion, PLLC

(57) ABSTRACT

An arc runner has a pair of side panels covering movable contacts and fixed contacts from a width direction of a movable contactor, a back panel covering the movable contacts and the fixed contacts from a longitudinal direction of the movable contactor, and a top panel covering the movable contacts and the fixed contacts from above, is formed of a magnetic material, and guides arcs to be generated between the movable contacts and the fixed contacts when the movable contacts and the fixed contacts separate from each other, toward an upward direction of the movable contactor. Furthermore, the arc runner includes, in a central portion of the top panel, a top panel hole flow-path area which is larger than top-panel to side-panel gaps formed between the side panels and the top panel.

5 Claims, 8 Drawing Sheets

(51) Int. Cl.

| | |
|---|---|
| ***H01H 9/48*** | (2006.01) |
| ***H01H 50/54*** | (2006.01) |
| ***H01H 1/12*** | (2006.01) |
| *H01H 50/38* | (2006.01) |

(56) References Cited

U.S. PATENT DOCUMENTS

| | | | | |
|---|---|---|---|---|
| 8,362,858 | B2 * | 1/2013 | Kurasawa | 335/126 |
| 8,570,125 | B2 * | 10/2013 | Suzuki et al. | 335/185 |
| 8,928,436 | B2 * | 1/2015 | Hirabayashi | 335/131 |
| 8,941,453 | B2 * | 1/2015 | Yano et al. | 335/131 |
| 2007/0139146 | A1 * | 6/2007 | Kusumoto et al. | 335/131 |
| 2007/0194868 | A1 * | 8/2007 | Kurasawa | 335/132 |
| 2009/0284335 | A1 * | 11/2009 | Kim et al. | 335/201 |

FOREIGN PATENT DOCUMENTS

| | | | |
|---|---|---|---|
| JP | 57-155624 | U | 9/1982 |
| JP | 59-115542 | U | 8/1984 |
| JP | 63-200423 | A | 8/1988 |
| JP | 06-223669 | A | 8/1994 |
| JP | 08315706 | A | 11/1996 |
| JP | 3262881 | B2 | 3/2002 |

OTHER PUBLICATIONS

Communication dated Sep. 11, 2014 from the Taiwanese Intellectual Property Office in counterpart application No. 101134650.

International Search Report of PCT/JP2012/062631 dated Jul. 17, 2012.

Communication dated Jun. 9, 2015 from Japanese Patent Office issued in corresponding application No. 2014515425.

* cited by examiner (a)

(b)

ELECTROMAGNETIC SWITCH

CROSS REFERENCE TO RELATED APPLICATIONS

This is a National Stage of International Application No. PCT/JP2012/062631 filed May 17, 2012, the contents of which are incorporated herein by reference in its entirety.

FIELD

The present invention relates to an electromagnetic switch that includes contacts and switches a current.

BACKGROUND

In an electromagnetic switch, an arc is generated between fixed contacts and movable contacts when a current is cut off. An arc sometimes melts both contacts and directly exerts an influence on the life of the electromagnetic switch. Therefore, there has been desired a development of an electromagnetic switch that is capable of promptly extinguishing an arc to be generated and whose contact life is long.

In order to improve the arc-extinguishing performance, Patent Literatures 1 and 2 describe a technique of installing an arc runner that is extended to a back surface of a movable contactor in a case, attracting an arc to the arc runner by an electromagnetic force, and extending the arc to extinguish it.

CITATION LIST

Patent Literatures

Patent Literature 1: Japanese Patent Publication No. 3262881

Patent Literature 2: Japanese Utility Model Laid-open Publication No. S59-115542

SUMMARY

Technical Problem

In order to improve the arc-extinguishing performance of an electromagnetic switch, an arc runner extended to the back surface of the movable contactor is installed and an arc is attracted by an electromagnetic force; however, in this case, there is a problem that the arc deviates from the arc runner and moves to an adjacent phase, so that an inter-phase short circuit is caused.

The present invention has been achieved in view of the above problem, and an object of the present invention is to provide an electromagnetic switch that prevents an inter-phase short circuit and has a high arc-extinguishing performance.

Solution to Problem

The present invention is directed to an electromagnetic switch that achieves the object. The electromagnetic switch includes a fixed iron core that is fixed on a casing; a movable iron core that is arranged to be opposite to the fixed iron core; a tripping spring that energizes the movable iron core in a direction of separating the movable iron core from the fixed iron core; an operation coil that is installed around the fixed iron core and generates an electromagnetic force for attracting the movable iron core to the fixed iron core against an elastic force of the tripping spring at a time of magnetization;

a cross bar in which a plurality of rod-shaped movable contactors, each movable contactor having a pair of movable contacts on both ends, is provided is installed, and to which the movable iron core is attached and that moves with the movable iron core; a plurality of fixed contactors on which, each fixed contactor having fixed contacts corresponding to the movable contacts, the fixed contacts are arranged so as to be positioned under the movable contacts, wherein the movable contacts contact or leave the fixed contacts in response to magnetization or demagnetization of the operation coil; and an arc runner that includes a pair of side panels covering the movable contacts and the fixed contacts from a width direction of the movable contactor, a back panel covering the movable contacts and the fixed contacts from a longitudinal direction of the movable contactor, and a top panel covering the movable contacts and the fixed contacts from above, and that is formed of a magnetic material and guides arcs to be generated between the movable contacts and the fixed contacts when the movable contacts and the fixed contacts separate from each other, toward an upward direction of the movable contactor. The arc runner includes, in a central portion of the top panel, a top panel hole whose flow-path area is larger than an area of gaps formed between the side panels and the top panel.

Advantageous Effects of Invention

The electromagnetic switch according to the present invention can improve the arc-extinguishing performance without causing any inter-phase short circuit.

DESCRIPTION OF EMBODIMENTS

Exemplary embodiments of an electromagnetic switch according to the present invention will be explained below in detail with reference to the accompanying drawings. The present invention is not limited to the embodiments.

First Embodiment

Figure 1:
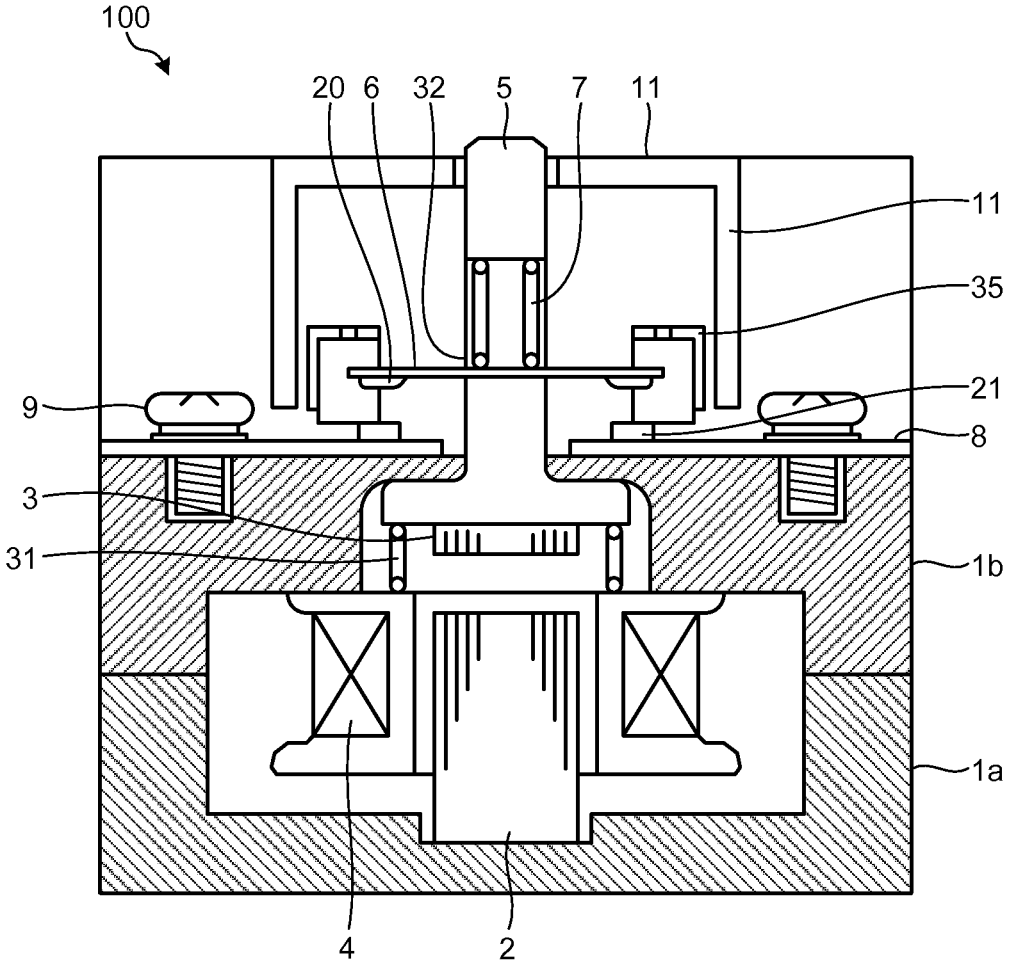
FIG. 1 is a cross-sectional view showing a configuration of an electromagnetic switch according a first embodiment of the present invention.

FIG. 1 is a cross-sectional view showing a configuration of an electromagnetic switch according a first embodiment of the present invention. A fixed iron core 2 in which silicon steel plates are laminated is fixed on a mount 1*a* molded by an insulating material. Fixed contactors 8 are attached to a base 1*b* molded by an insulating material like the mount 1*a*. The mount 1*a* and the base 1*b* constitute a casing 1. A movable iron core 3 is an iron core in which the silicon steel plates are laminated like the fixed iron core 2. The movable iron core 3 and the fixed iron core 2 are arranged to be opposite to each other. At the time of magnetization, an operation coil 4 generates a driving force that attracts the movable iron core 3 to the fixed iron core 2 against an elastic force of a tripping spring 31. A cross bar 5 in which a square window 32 is provided is formed of an insulating material, and the cross bar 5 holds the movable iron core 3 at a lower end thereof.

A movable contactor 6 is rod-shaped, inserted into the square window 32 of the cross bar 5, and held by a pressing spring 7. The fixed contactors 8 are provided to be opposite to the movable contactor 6, and a current flows when both contactors contact each other. Three pairs of the movable contactor 6 and the fixed contactors 8 are provided to correspond to each phase of a three-phase alternating current. A pair of movable contacts 20 is separated on both end sides of the movable contactor 6 and bonded with the movable contactor 6, and fixed contacts 21 are bonded with the fixed contactors 8. Terminal screws 9 are used to connect an electromagnetic switch 100 to an external circuit.

In the electromagnetic switch 100, when the movable contacts 20 and the fixed contacts 21 are opened, arcs are generated between these contacts. An arc cover 11 is installed to cover a top surface of the electromagnetic switch 100, and prevents the arcs from being discharged outside. An arc runner 35 attracts arcs generated between the movable contacts 20 and the fixed contacts 21 when the movable contacts 20 and the fixed contacts 21 are separated from each other, guides the arcs toward the upward direction of the movable contactor 6, and extends the arcs to extinguish them. The arc runner 35 is fixed on the base 1*b* or the arc cover 11 and surrounds the movable contacts 20 and the fixed contacts 21. A part of the arc runner 35 covers a back surface of the movable contactor 6.

Figure 2:
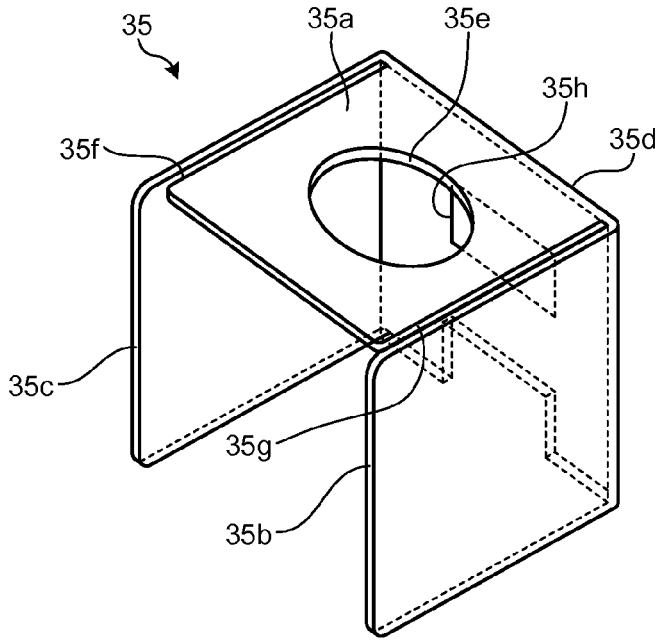
FIG. 2 is a perspective view of an arc runner.

FIG. 2 is a perspective view of the arc runner. The arc runner 35 includes an arc-runner top panel 35*a* that covers the movable contact 20 and the fixed contact 21 from the upward direction of the movable contactor 6, arc-runner side panels 35*b* and 35*c* that cover the movable contact 20 and the fixed contact 21 from a width direction of the movable contactor 6, and an arc-runner back panel 35*d* that covers the movable contact 20 and the fixed contact 21 from a longitudinal direction of the movable contactor 6. The arc-runner back panel 35*d* and the arc-runner side panels 35*b* and 35*c* are physically connected to each other, and the arc-runner top panel 35*a* and the arc-runner back panel 35*d* are also physically connected to each other.

In the arc-runner top panel 35*a*, a top panel hole 35*e* is provided in a central portion thereof. The area of the top panel hole 35*e* is set to be larger than a total sum of areas of top-panel to side-panel gaps 35*f* and 35*g*, which are gaps formed by the arc-runner side panel 35*c* and the arc-runner top panel 35*a*. While the shape of the top panel hole 35*e* is circular in FIG. 2, the shape can be rectangular or oval. A back panel hole 35*h* is provided in the arc-runner back panel 35*d*. While the shape of the back panel hole 35*h* is rectangular in FIG. 2, the shape can be circular or oval.

The arc runner 35 is manufactured by using a material having magnetism in order to attract arcs. In the present embodiment, the arc runner 35 is assumed to be configured by a ferromagnetic material (such as iron, or iron plated with nickel, copper, tin, zinc, or the like).

Figure 3:
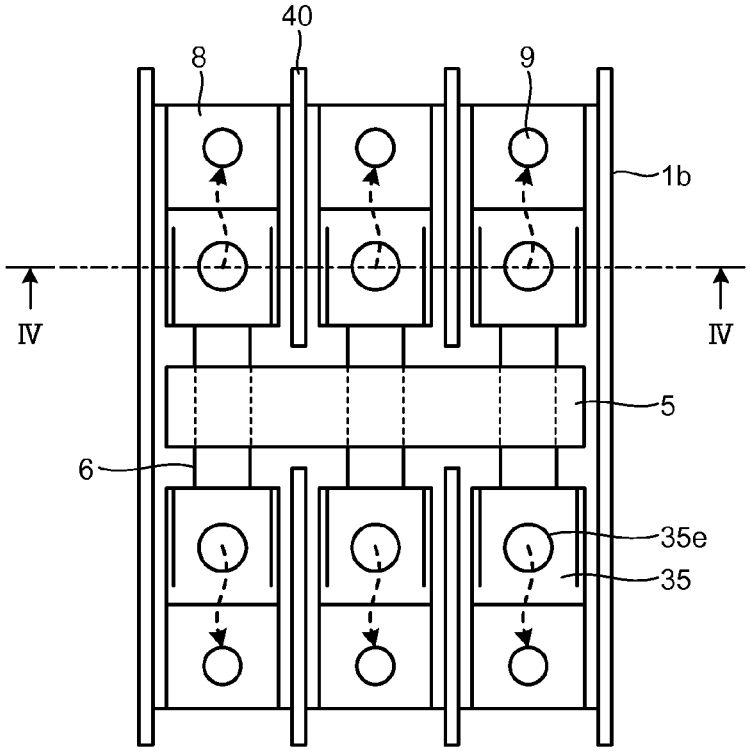
FIG. 3 is a schematic diagram of the electromagnetic switch in a state where an arc cover is taken off.

FIG. 3 is a schematic diagram of the electromagnetic switch in a state where an arc cover is taken off. Inter-phase walls 40 are provided so as to partition respective phases in a direction perpendicular to the cross bar 5, and when an arc is generated, the inter-phase wall 40 prevents the arc from moving to an adjacent phase and causing an inter-phase short circuit. The arc runner 35 is installed at six locations so as to correspond to a pair of the movable contact 20 and the fixed contact 21. A dashed arrow in FIG. 3 indicates a flow of air when the movable iron core 3 is separated from the fixed iron core 2, and air in a portion surrounded by the arc runner 35 flows from the top panel hole 35*e* to outside of the arc runner 35. This flow of air is described later.

Figure 4:
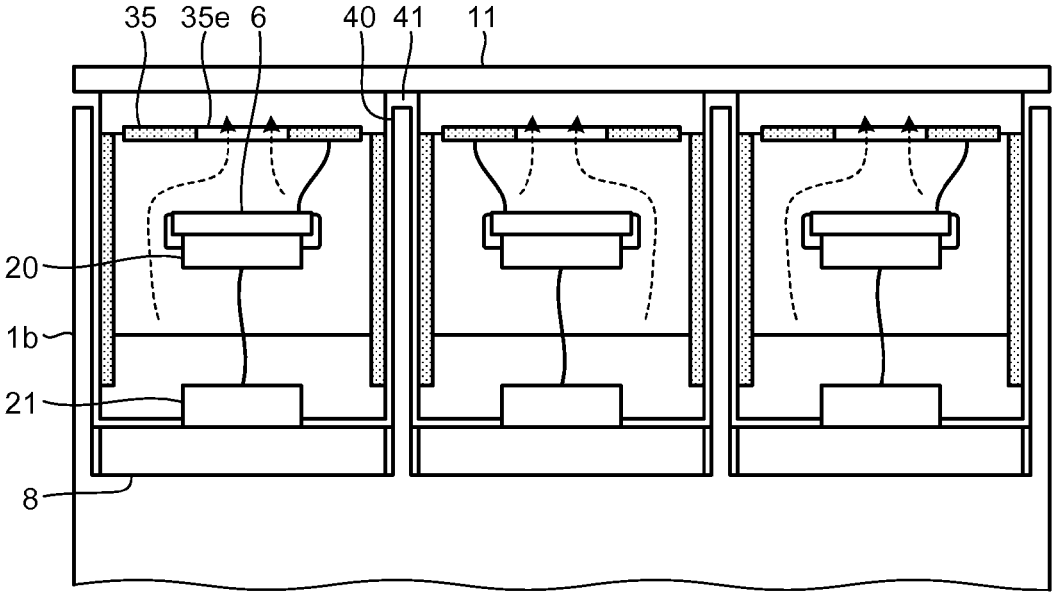
FIG. 4 is a cross sectional view of the electromagnetic switch in a state where the arc cover is taken off.

FIG. 4 is a cross sectional view of the electromagnetic switch in a state where an arc cover is taken off, and shows a cross section taken along a line IV-IV in FIG. 3. An inter-phase wall gap 41 is created between the inter-phase wall 40 and the arc cover 11. A dashed arrow in FIG. 4 indicates a flow of air when the movable iron core 3 is separated from the fixed iron core 2, and air in a portion surrounded by the arc runner 35 flows from the top panel hole 35*e* to outside of the arc runner 35. This flow of air is described later.

Operations are described next. When the operation coil 4 is magnetized, the movable iron core 3 is attracted to the fixed iron core 2 against the tripping spring 31. With this movement of the movable iron core 3, the cross bar 5 and the movable contactor 6 move and the movable contact 20 comes into contact with the fixed contact 21. Even after the movable contact 20 has come into contact the fixed contact 21, the movable iron core 3 and the cross bar 5 continue to move. However, because the movable contact 20 is in contact with the fixed contact 21, the movement of the movable contactor 6 is restricted and the pressing spring 7 shrinks. The movable contact 20 and the fixed contact 21 are pressurized, the contact resistance between these contacts is reduced, and a current flows.

Figure 5:
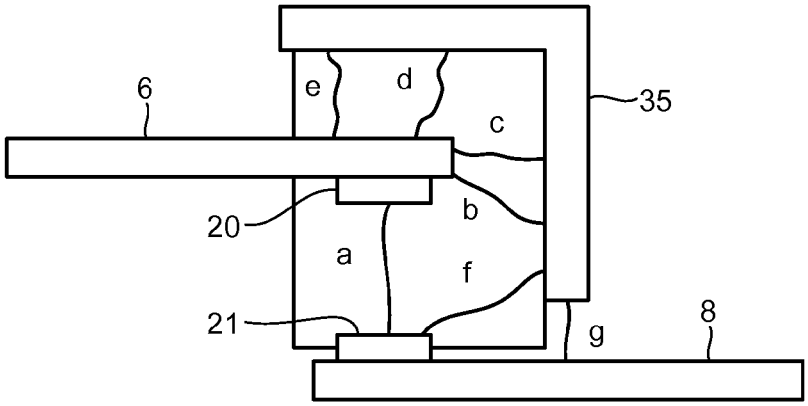
FIG. 5 is a partial cross-sectional view of the electromagnetic switch.

When the operation coil 4 is demagnetized, the movable iron core 3 is separated from the fixed iron core 2 by the tripping spring 31. With this operation, the cross bar 5 also moves upward and the fixed contact 21 is separated from the movable contact 20. At this time, an arc is generated between the both contacts. FIG. 5 is a partial cross-sectional view of the electromagnetic switch. When the both contacts are just opened, an arc is generated at a position "a". Because an arc is a current, it generates a magnetic field. The arc runner 35 is configured by a ferromagnetic material. The arc-runner side panel 35*b* and the arc-runner back panel 35*d* are physically connected to each other, and the arc-runner side panel 35*c* and the arc-runner back panel 35*d* are physically connected to each other. Therefore, the magnetic flux density passing through the arc-runner side panel 35*b*, the arc-runner back panel 35*d*, and the arc-runner side panel 35*c* increases, a large electromagnetic force acts on the arc, and a position of the arc is changed as a→b→c→d→e.

Furthermore, because the back panel hole 35*h* is provided in the arc-runner back panel 35*d*, an electric field at a corner in the direction of a hole thickness becomes strong, and this also causes the arc to be easily moved from the position "a" to the positions "b" and "c".

When the arc moves from the position "a" to the position "b", the arc is divided and the position of the divided arc shifts from "f" to "g". Because the arc moves from a contact gap in this way, it is extended, cooled, and divided. An arc voltage increases as the arc is extended and cooled. Furthermore, as the arc is divided, generation points of a cathode fall voltage or an anode fall voltage increase, and therefore the arc voltage further increases. Accordingly, the arc is easily extinguished. Further, because the arc does not remain in the movable contact 20 or the fixed contact 21, wear of the contact is suppressed.

By the generation of an arc, ambient air is heated and expanded. If there is no top panel hole 35*e* having a large flow-path area, air flows out from the top-panel to side-panel gaps 35*f* and 35*g*. The arc is driven by an electromagnetic force and comes under an influence of an air flow. Therefore, along with an outflow of air from the top-panel to side-panel gaps 35*f* and 35*g*, the arc also flows out from the top-panel to side-panel gaps 35*f* and 35*g*. The arc having flowed out from the top-panel to side-panel gaps 35*f* and 35*g* passes through the inter-phase wall gap 41, moves to an adjacent phase, and becomes a cause of an inter-phase short circuit.

In a case where there is an arc runner extended to a back surface of a movable contactor, an arc is extended, cooled, and divided to improve the arc-extinguishing performance. However, because of the reasons described above, there is a problem that the arc deviates from the arc runner, moves to an adjacent phase, and causes an inter-phase short circuit. The problem is caused by the fact that the arc is affected by air flow.

In the present embodiment, because there is provided the top panel hole 35*e*, which has a flow-path area larger than a total sum of flow-path areas of the top-panel to side-panel gaps 35*f* and 35*g*, expanded air flows out from the top panel hole 35*e* having a large flow-path area. Air having flowed out from the top panel hole 35*e* is discharged outside through the flow shown by the dashed arrows in FIG. 3. There is a possibility that, along with an outflow of air from the top panel hole 35*e*, the arc also flows out from the top panel hole 35*e*. However, the top panel hole 35*e* is provided in the central portion of the arc-runner top panel 35*a*, and thus the arc does not move to an adjacent phase. Accordingly, any inter-phase short circuit is not caused. Even if the arc moves along with the air flow, the movement is blocked by the arc cover 11, and thus the arc is not discharged outside.

As described above, according to the present embodiment, any inter-phase short circuit is not caused and an arc can be further extended and cooled, and thus the arc-extinguishing performance can be improved.

Second Embodiment

Figure 6:
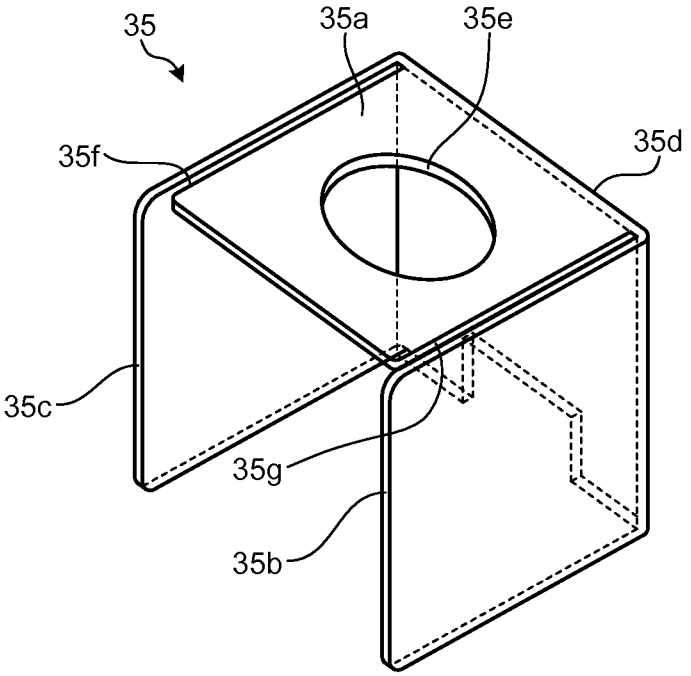
FIG. 6 is a perspective view of an electromagnetic switch according to a second embodiment of the present invention.

FIG. 6 is a perspective view of an electromagnetic switch according to a second embodiment of the present invention. The second embodiment differs from the first embodiment in that a back panel hole is not provided in the arc-runner back panel 35*d*. Other features of the second embodiment are identical to those of the first embodiment.

In the present embodiment, there is no increase of an electric field at a corner of the back panel hole. Similarly to the first embodiment, an arc is moved by an electromagnetic force, and is extended, cooled, and divided, thereby improving the arc-extinguishing performance.

Also in the present embodiment, it is possible to improve the arc-extinguishing performance without causing any inter-phase short circuit.

Third Embodiment

Figure 7:
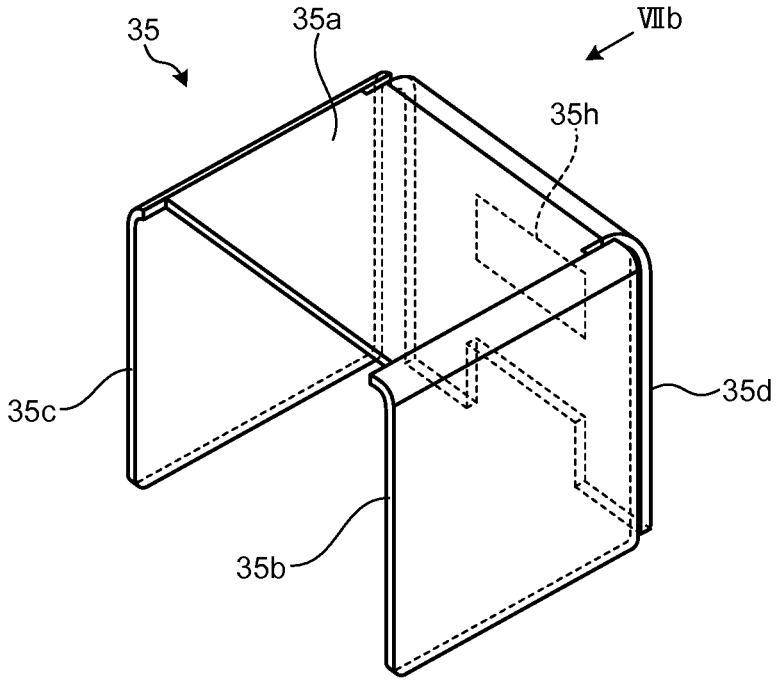
FIG. 7 are perspective views of an electromagnetic switch according to a third embodiment of the present invention.
Figure 7:
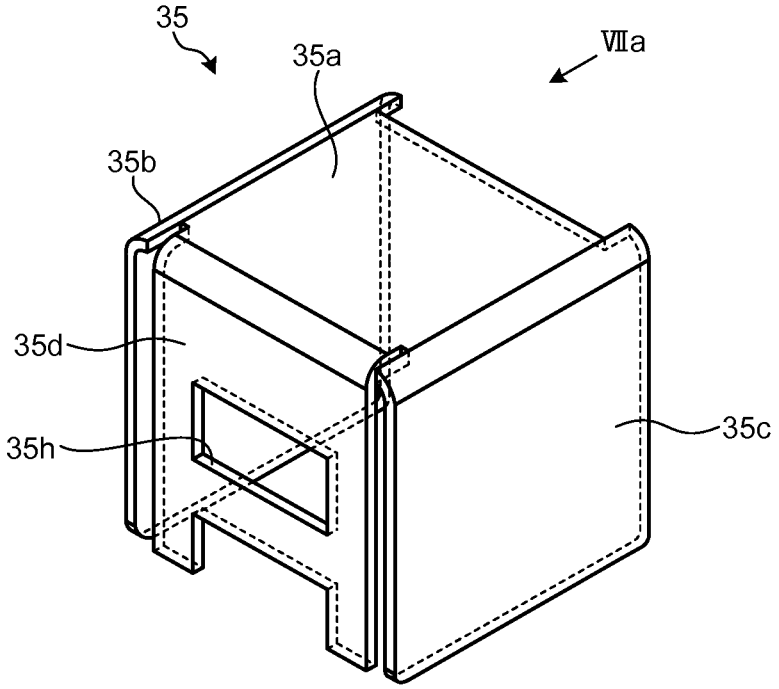

FIG. 7 are perspective views of an electromagnetic switch according to a third embodiment of the present invention. FIG. 7(*a*) shows a state (a state as viewed from the direction of an arrow VIIa in FIG. 7(*b*)) as viewed from a front surface side, and FIG. 7(*b*) shows a state (a state as viewed from the direction of an arrow VIIb in FIG. 7(*a*)) as viewed from a back surface side. The third embodiment differs from the first embodiment in that a top-panel to side-panel gap is not provided, and the arc-runner side panel 35*b* and the arc-runner back panel 35*d* are not physically connected to each other, and the arc-runner side panel 35*c* and the arc-runner back panel 35*d* are not physically connected to each other. Other features of the third embodiment are identical to those of the first embodiment.

Because the arc-runner side panels 35*b* and 35*c* are not physically connected to the arc-runner back panel 35*d*, the magnetic flux density among the arc-runner side panel 35*b*, the arc-runner back panel 35*d*, and the arc-runner side panel 35*c* is slightly reduced, and an electromagnetic force applied to an arc is slightly reduced as compared to that of the first embodiment; however, it is a sufficient electromagnetic force for moving the arc. Accordingly, the arc is extended, cooled, and divided by the movement of the arc, thereby improving the arc-extinguishing performance.

Figure 8:
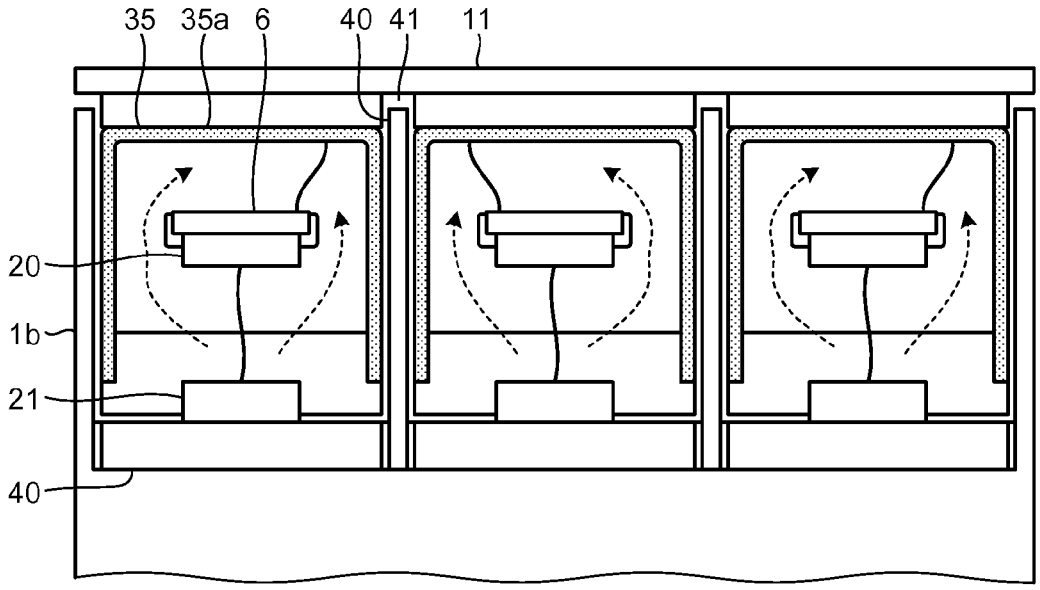
FIG. 8 is a partial cross-sectional view of the electromagnetic switch according to the third embodiment.

FIG. 8 is a partial cross-sectional view of the electromagnetic switch according to the third embodiment. A dashed arrow in FIG. 8 indicates a flow of air when the movable iron core 3 is separated from the fixed iron core 2. Because a top-panel to side-panel gap is not provided in the present embodiment, air expanded at the time of arc generation flows out from the back panel hole 35*h* and the air does not flow out at all from a part of the arc-runner top panel 35*a*. Accordingly, there is no possibility that air expanded by the arc passes through an inter-phase gap and moves to an adjacent phase. Therefore, it is possible to completely prevent the arc from moving to an adjacent phase by the influence of an air flow, and prevent an inter-phase short circuit from being caused.

In this way, according to the present embodiment, an inter-phase short circuit can be completely prevented from being caused and the arc-extinguishing performance can be improved.

As an example, taking manufacturing easiness into consideration, the present embodiment has a configuration in which the arc-runner side panels 35*b* and 35*c* are not physically connected to the arc-runner back panel 35*d*. However, even when the arc-runner side panels 35*b* and 35*c* are physically connected to the arc-runner back panel 35*d* by a method such as brazing, soldering, and welding, an inter-phase short circuit can be completely prevented from being caused, and effects equivalent to or better than those of the present embodiment can be obtained with respect to the arc-extinguishing performance.

Fourth Embodiment

Figure 9:
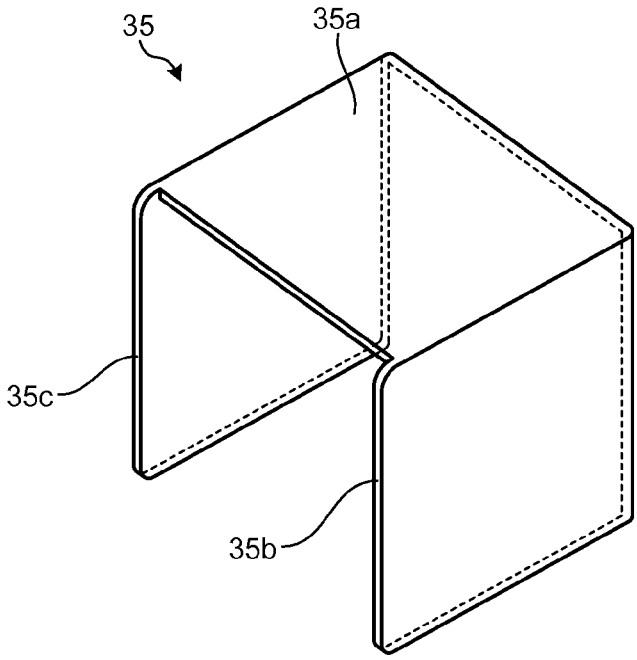
FIG. 9 is a perspective view of an electromagnetic switch according a fourth embodiment of the present invention.

FIG. 9 is a perspective view of an electromagnetic switch according a fourth embodiment of the present invention. The fourth embodiment differs from the first embodiment in that an arc-runner back panel is not provided.

While the magnetic flux density in the present embodiment is reduced as compared to that in the first embodiment, only by increasing the magnetic flux density in the arc-runner side panels 35*b* and 35*c*, an arc can be moved similarly to the first embodiment. Therefore, the arc is extended, cooled, and divided by the movement of the arc, thereby improving the arc-extinguishing performance.

In the present embodiment, because top-panel to side-panel gaps are not provided, there is no possibility that air expanded by the arc passes through an inter-phase gap and moves to an adjacent phase. Therefore, it is possible to completely prevent the arc from moving to an adjacent phase by the influence of an air flow, and prevent an inter-phase short circuit from being caused.

In this way, according to the present embodiment, an inter-phase short circuit can be completely prevented from being caused and the arc-extinguishing performance can be improved.

Fifth Embodiment

Figure 10:
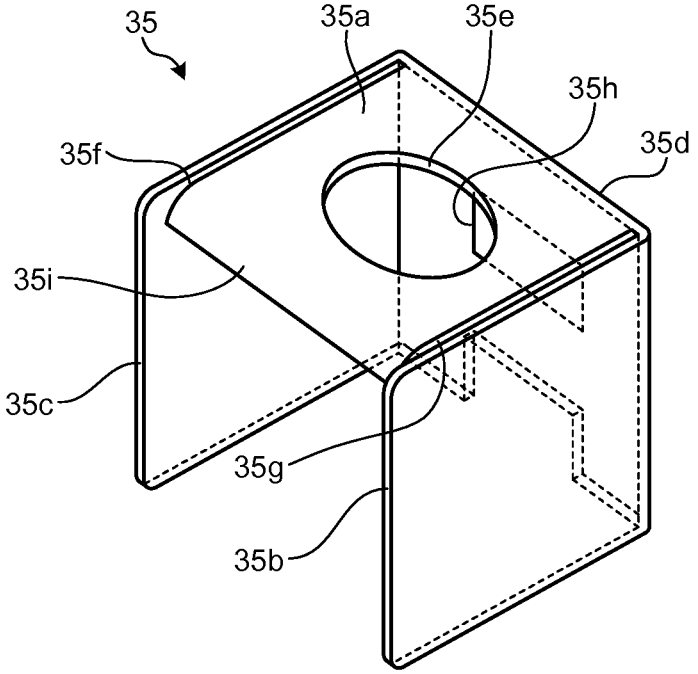
FIG. 10 is a perspective view of an electromagnetic switch according to a fifth embodiment of the present invention.
Figure 11:
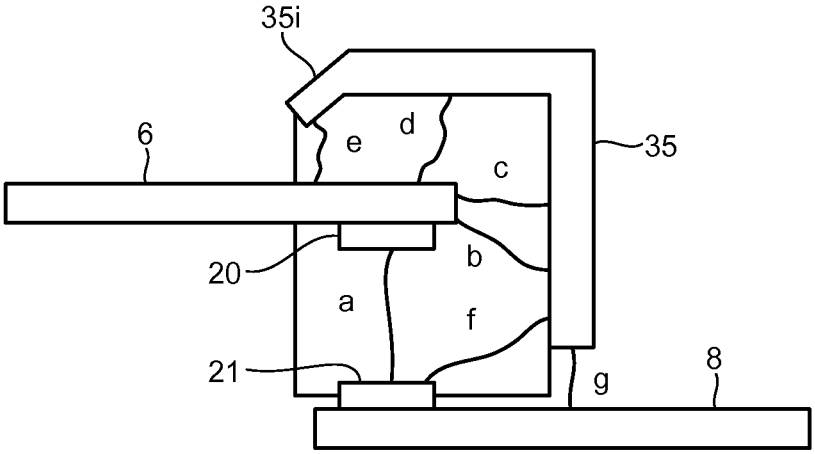
FIG. 11 is a partial cross-sectional view of the electromagnetic switch according to the fifth embodiment.

FIG. 10 is a perspective view of an electromagnetic switch according to a fifth embodiment of the present invention. FIG. 11 is a partial cross-sectional view of the electromagnetic switch according to the fifth embodiment. The fifth embodiment differs from the first embodiment in that a tip end (an end of a side separated from the arc-runner back panel 35*d*) 35*i* of the arc-runner top panel 35*a* is bent toward a side of the movable contactor 6. With this configuration, as for the distance between the arc-runner top panel 35*a* and the movable contactor 6, the distance in the part of the tip end 35*i* is smaller than that in the part except for the tip end 35*i*. Therefore, after an arc moves from "a" to "d" in FIG. 11, the movement from "d" to "e" is facilitated. Accordingly, due to the movement of the arc, the arc is extended, cooled, and divided, thereby improving the arc-extinguishing performance.

Furthermore, as air expanded by heat of the arc is caused to flow out from the top panel hole 35*e*, the arc does not move to an adjacent phase and an inter-phase short circuit can be prevented.

Also in the present embodiment, it is possible to improve the arc-extinguishing performance without causing any inter-phase short circuit.

Sixth Embodiment

Figure 12:
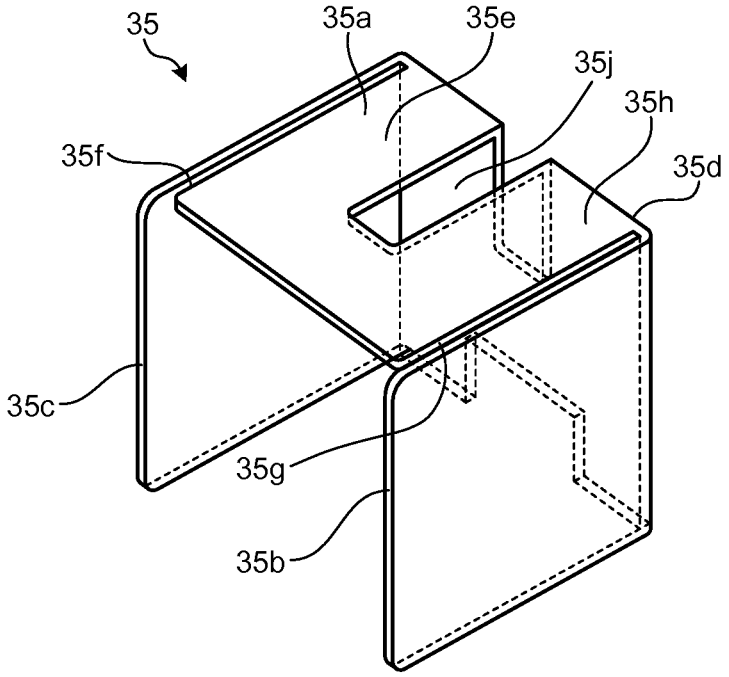
FIG. 12 is a perspective view of an electromagnetic switch according to a sixth embodiment of the present invention.

FIG. 12 is a perspective view of an electromagnetic switch according to a sixth embodiment of the present invention. The sixth embodiment differs from the first embodiment in that a back panel hole provided in the arc-runner back panel 35*d* and a top panel hole provided in the arc-runner top panel 35*a* are integrated to be a top-panel to back-panel hole 35*j*. In other words, the top panel hole is formed so as to reach the back panel, and these holes are made to be the top-panel to back-panel hole 35*j*. The flow-path area of the top-panel to back-panel hole 35*j* is larger than a total sum of the flow-path areas of the top-panel to side-panel gaps 35*f* and 35*g*.

Also in the present embodiment, similarly to the first embodiment, an arc is moved by an electromagnetic force and the arc is extended, cooled, and divided, thereby improving the arc-extinguishing performance.

In the present embodiment, because the top-panel to back-panel hole 35*j* having a large flow-path area is provided, expanded air flows out from the top-panel to back-panel hole 35*j* having a large flow-path area. There is a possibility that, along with an outflow of air from the top-panel to back-panel hole 35*j*, the arc also flows out from the top-panel to back-panel hole 35*j*. However, the top-panel to back-panel hole 35*j* is provided in the central portion of the arc-runner top panel 35*a* and the arc-runner back panel 35*d*, and thus the arc having flowed out from the top-panel to back-panel hole 35*j* does not move to an adjacent phase. Therefore, any inter-phase short circuit is not caused.

Also in the present embodiment, it is possible to improve the arc-extinguishing performance without causing any inter-phase short circuit.

INDUSTRIAL APPLICABILITY

As described above, the electromagnetic switch according to the present invention is useful in being capable of improving the arc-extinguishing performance without causing any inter-phase short circuit.

REFERENCE SIGNS LIST

1 casing
1*a* mount
1*b* base
2 fixed iron core
3 movable iron core
4 operation coil
5 cross bar
6 movable contactor
7 pressing spring
8 fixed contactor
11 arc cover
20 movable contact
21 fixed contact
31 tripping spring
32 square window
35 arc runner
35*a* arc-runner top panel
35*b*, 35*c* arc-runner side panel
35*d* arc-runner back panel
35*e* top panel hole
35*i* tip end
35*f*, 35*g* top-panel to side-panel gap
35*h* back panel hole
35*j* top-panel to back-panel hole
40 inter-phase wall
41 inter-phase wall gap
100 electromagnetic switch

The invention claimed is:

1. An electromagnetic switch comprising:

a fixed iron core that is fixed on a casing;

a movable iron core that is arranged to be opposite to the fixed iron core;

a tripping spring that energizes the movable iron core in a direction of separating the movable iron core from the fixed iron core;

an operation coil that is installed around the fixed iron core and generates an electromagnetic force for attracting the movable iron core to the fixed iron core against an elastic force of the tripping spring at a time of magnetization;

a cross bar in which a plurality of rod-shaped movable contactors, each movable contactor having a pair of movable contacts on both ends thereof, is installed, and to which the movable iron core is attached and that moves with the movable iron core;

a plurality of fixed contactors, each fixed contactor having fixed contacts corresponding to the movable contacts, the fixed contacts being arranged so as to be positioned under the movable contacts, wherein the movable contacts contact or leave the fixed contacts in response to magnetization or demagnetization of the operation coil; and an arc runner that includes a pair of side panels covering the movable contacts and the fixed contacts from a width direction of the movable contactor, a back panel covering the movable contacts and the fixed contacts from a longitudinal direction of the movable contactor, and a top panel covering the movable contacts and the fixed contacts from above, and that is formed of a magnetic material and guides arcs to be generated between the movable contacts and the fixed contacts when the movable contacts and the fixed contacts separate from each other, toward an upward direction of the movable contactor, wherein the arc runner includes, in a central portion of the top panel, a top panel hole whose flow-path area is larger than an area of gaps formed between the side panels and the top panel.

2. The electromagnetic switch according to claim 1, wherein the side panels are connected to the back panel.

3. The electromagnetic switch according to claim 1, wherein the top panel hole is formed so as to reach the back panel.

4. The electromagnetic switch according to claim 1, wherein an end of the top panel on a side separated from the back panel is bent toward a side of the movable contactor.

5. The electromagnetic switch according to claim 1, wherein the arc runner is formed of a ferromagnetic material.

* * * * *